US009799283B2

(12) United States Patent
Yao et al.

(10) Patent No.: US 9,799,283 B2
(45) Date of Patent: Oct. 24, 2017

(54) HSD LIQUID CRYSTAL DISPLAY PANEL, DISPLAY DEVICE AND DRIVING METHOD THEREOF

(71) Applicant: SHENZHEN CHINA STAR OPTOELECTRONICS TECHNOLOGY CO., LTD., Shenzhen, Guangdong (CN)

(72) Inventors: Xiaohui Yao, Shenzhen (CN); Caiqin Chen, Shenzhen (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 373 days.

(21) Appl. No.: 14/406,707

(22) PCT Filed: Jun. 26, 2014

(86) PCT No.: PCT/CN2014/080884
§ 371 (c)(1),
(2) Date: Dec. 9, 2014

(87) PCT Pub. No.: WO2015/184660
PCT Pub. Date: Dec. 10, 2015

(65) Prior Publication Data

US 2016/0267862 A1 Sep. 15, 2016

(30) Foreign Application Priority Data

Jun. 4, 2014 (CN) ..... 2014 1 0244232

(51) Int. Cl.
*G09G 3/36* (2006.01)

(52) U.S. Cl.
CPC ..... *G09G 3/3614* (2013.01); *G09G 3/3611* (2013.01); *G09G 3/3685* (2013.01);
(Continued)

(58) Field of Classification Search
CPC ..... G09G 3/3614; G09G 3/3685; G09G 2300/0452; G09G 2310/0251; G09G 2320/0223
See application file for complete search history.

(56) References Cited

U.S. PATENT DOCUMENTS 5,151,689 A 9/1992 Kabuto et al.
2010/0110046 A1* 5/2010 Chen ..... G09G 3/3614 345/204

(Continued)

FOREIGN PATENT DOCUMENTS

CN 101866607 A 5/2010
CN 1808250 A1 7/2010

OTHER PUBLICATIONS

International Search Report for PCT/CN2014/080884 dated Feb. 26, 2015.

*Primary Examiner* — Ariel Balaoing
(74) *Attorney, Agent, or Firm* — Kim Winston LLP

(57) ABSTRACT

The present disclosure discloses a HSD liquid crystal display panel, a display device and a driving method thereof. Said display panel comprises a plurality of sub pixel unit groups connected with data lines and scanning lines, wherein each data line comprises a plurality of winding parts; and wherein the sub pixel unit groups that are spaced from each other by k rows and connected to data line i and the sub pixel unit groups that are spaced from each other by k rows and connected to data line i+m are located in the same column group, so that during display driving the polarity of a sub pixel unit group is opposite to that of its adjacent sub pixel unit group in the same row, and the polarity of a sub pixel unit group is the same as that of the sub pixel unit group which is spaced from said sub pixel unit
(Continued)

group by k rows in the same column group, i and k being positive integers and m being odd number.

18 Claims, 9 Drawing Sheets

(52) U.S. Cl.
CPC ..... *G09G 2300/0426* (2013.01); *G09G 2300/0452* (2013.01); *G09G 2310/0213* (2013.01); *G09G 2310/0251* (2013.01); *G09G 2310/08* (2013.01); *G09G 2320/0223* (2013.01)

(56) References Cited

U.S. PATENT DOCUMENTS

| | | | | |
|---|---|---|---|---|
| 2010/0182289 | A1 | 7/2010 | Hsu et al. | |
| 2013/0147698 | A1 | 6/2013 | Kang et al. ..... | 345/88 |

* cited by examiner

HSD LIQUID CRYSTAL DISPLAY PANEL, DISPLAY DEVICE AND DRIVING METHOD THEREOF

CROSS-REFERENCE TO RELATED APPLICATIONS

The present application claims benefit of Chinese patent application CN 201410244232.1, entitled "A HSD Liquid Crystal Display Panel, Display Device and Driving Method Thereof" and filed on Jun. 4, 2014, which is incorporated herein by reference.

FIELD OF THE INVENTION

The present disclosure relates to the technical field of liquid crystal display, particularly to a HSD liquid crystal display panel, a display device and a driving method thereof.

BACKGROUND OF THE INVENTION

In the prior art, the sub pixels adjacent to each other along a horizontal direction of Half Source Driving (HSD) pixel array share the same data line, enabling the number of data lines being half of the number of data lines of traditional liquid crystal driving pixel array. The adjacent sub pixels in the same row are connected to different scanning lines, and sub pixels spaced from each other by one sub pixel in the same row are connected to the same scanning line, so that the sub pixels adjacent to each other along the vertical direction are connected to different scanning lines. Therefore, the number of scanning lines is double of the number of scanning lines of traditional liquid crystal driving pixel array.

As the number of scanning lines doubles in the HSD pixel array, the scanning time allocated to each scanning line is reduced, thus the charging time of sub pixels being reduced accordingly. Due to the impedance of data lines, the delay distortion of waveform of the voltage signals would be generated during the transmission, and such distortion becomes more serious near the ends of data lines. Consequently, charging rate difference would be caused between sub pixels in odd-numbered columns and sub pixels in even-numbered columns at the ends of data lines. For example, sub pixels in odd-numbered columns driven at first are undercharged, and their brightness is relatively low. In contrast, sub pixels in even-numbered columns driven later are charged better, and their brightness is relatively high. Therefore, bright-dark lines would appear in the overall view of HSD pixel array.

In view of the above situation, a display panel which can improve the display defects of bright-dark lines in HSD pixel array is needed.

SUMMARY OF THE INVENTION

To solve the aforesaid problems, the present disclosure provides a HSD liquid crystal display panel, comprising a plurality of sub pixel unit groups connected with data lines and scanning lines. Each data line comprises a plurality of winding parts. The sub pixel unit groups that are spaced from each other by k rows and connected to data line i and the sub pixel unit groups that are spaced from each other by k rows and connected to data line i+m are located in the same column group, so that during display driving the polarity of a sub pixel unit group is opposite to that of its adjacent sub pixel unit group in the same row, and the polarity of a sub pixel unit group is the same as that of the sub pixel unit group which is spaced from said sub pixel unit group by k rows in the same column group. In the context, i and k are positive integers, and m is odd number.

In one embodiment of the present disclosure, the sub pixel unit groups connected to the same date line in the same column group are spaced from each other by k rows, and the sub pixel unit groups connected to the same date line in different column groups are spaced from each other by 2n column groups, k being positive integer and n being integer.

In one embodiment of the present disclosure, each data line further comprises vertical connecting parts connected with said winding parts and located between adjacent sub pixel unit groups.

In one embodiment of the present disclosure, each sub pixel unit group comprises a first sub pixel unit and a second sub pixel unit arranged side by side and located at both sides of the data line respectively.

In one embodiment of the present disclosure, said first sub pixel unit is connected with odd-numbered scanning line and said second sub pixel unit is connected with even-numbered scanning line.

The present disclosure also provides a liquid crystal display device comprising:

said liquid crystal display panel;

a scanning signal driving unit for providing sequence scanning pulse signals to said scanning lines, thus turning on the sub pixel units in respective rows; and a data signal driving unit for providing data signals to said data lines, thus charging the sub pixel units connected with said data lines when said sub pixel units are turned on, wherein the polarity of said data signal is reversed once through each frame cycle.

In one embodiment of the present disclosure, the polarity of data signals in odd-numbered data lines and the polarity of data signals in even-numbered data lines are opposite at the same moment.

In one embodiment of the present disclosure, further comprising a timing control unit for providing polarity reversing signals to reverse the polarity of said data signals once through each frame cycle, and to enable that the polarity of data signals in odd-numbered data lines and the polarity of data signals in even-numbered data lines are opposite at the same moment.

The present disclosure also provides a method of driving a HSD liquid crystal display device, comprising:

providing sequence scanning pulse signals to scanning lines to turn on sub pixel units in respective sub pixel unit groups; and providing data signals to data lines, thus charging the sub pixel units connected with a data line when a corresponding sub pixel unit is turned on, wherein the sub pixel unit groups spaced from each other by k rows connected to data line i and the sub pixel unit groups spaced from each other by k rows connected to data line i+m are located in the same column group, and the sub pixel unit groups connected to the same date line in the same column group are spaced from each other by k rows, and the sub pixel unit groups connected to the same date line in different column groups are spaced from each other by 2n column groups, i and k being positive integers, n being integer, and m being odd number; and wherein the polarity of said data signals reverse once through each frame cycle, so that during display driving the polarity of a sub pixel unit group is opposite to that of its adjacent sub pixel unit group in the same row, and the polarity of a sub pixel unit group is the same as that of the sub pixel unit group which is spaced from said sub pixel unit group by k rows in the same column group.

In one embodiment of the present disclosure, the polarity of data signals in odd-numbered data lines and the polarity of data signals in even-numbered data lines are opposite at the same moment.

According to the present disclosure, based on the arrangement of sub pixel units, a plurality of winding parts cooperating with the sub pixel units are provided in data lines, so that two-point reversion, four-point reversion or similar display effects can be achieved through the data driving method of column reversion. The polarity of data driving signal of each sub pixel unit keeps consistent in one frame cycle, which is different from the current HSD two-point reversion driving mode wherein polarity is inversed once in each row cycle. By means of which, the wiring delay effect of data lines can be alleviated, and the phenomenon of dark lines that may occur in current HSD technology can be eliminated. In addition, the vertical connecting parts connected to the plurality of winding parts are arranged between sub pixel units, so that the equivalent impedance of the whole data line is reduced, and the wiring delay effect is alleviated, thus incorrect charging at the end of the data line being avoided.

Other features and advantages of the present disclosure will be stated in the following description, and part of them will become obvious in the description or become understandable through the embodiments of the present disclosure. The objectives and other advantages of the present disclosure can be achieved and obtained through the structures specified in the description, claims and drawings.

BRIEF DESCRIPTION OF THE DRAWINGS

The accompanying drawings of the embodiments will be described simply in the following, in order to explain more clearly the technical solutions of the embodiments in the present disclosure.

DETAILED DESCRIPTION OF THE EMBODIMENTS

The present disclosure will be described in more detail below with reference to the drawings to further clarify the objectives, technical solutions and advantages of the present disclosure.

Example 1

Figure 1:
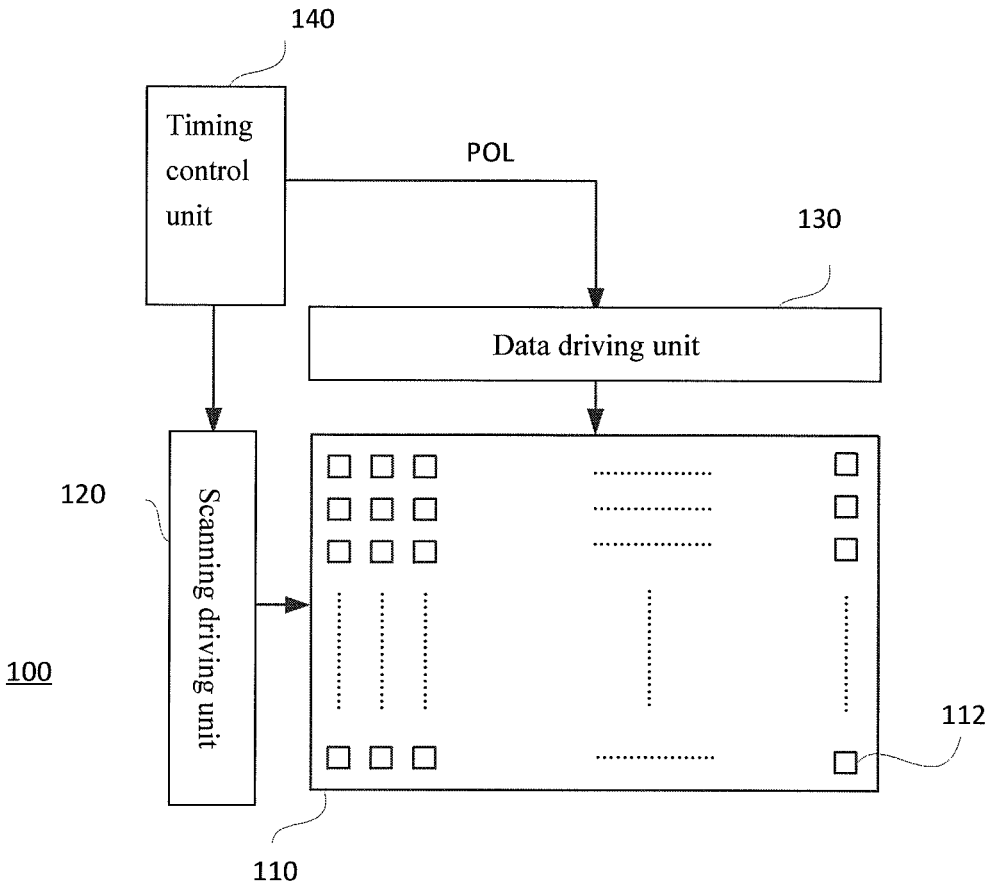
FIG. 1 is a structural schematic diagram of a HSD display device according to Example 1 of the present disclosure.

FIG. 1 is a structural schematic diagram of a HSD display device 100 according to the present Example. As shown in FIG. 1, the liquid crystal display device 100 comprises a display panel 110, a scanning driving unit 120, a data driving unit 130 and a timing control unit 140. The display panel 110 comprises a plurality of sub pixel units 112 arranged in a matrix form.

The scanning driving unit 120 and the data driving unit 130 are both electrically connected to the display panel 110. The timing control unit 140 is electrically connected to both of the scanning driving unit 120 and the data driving unit 130, in order to control the scanning driving unit 120 to scan the display panel 110 and control the data driving unit 130 to drive the display panel 110, so that the picture is displayed.

Figure 2:
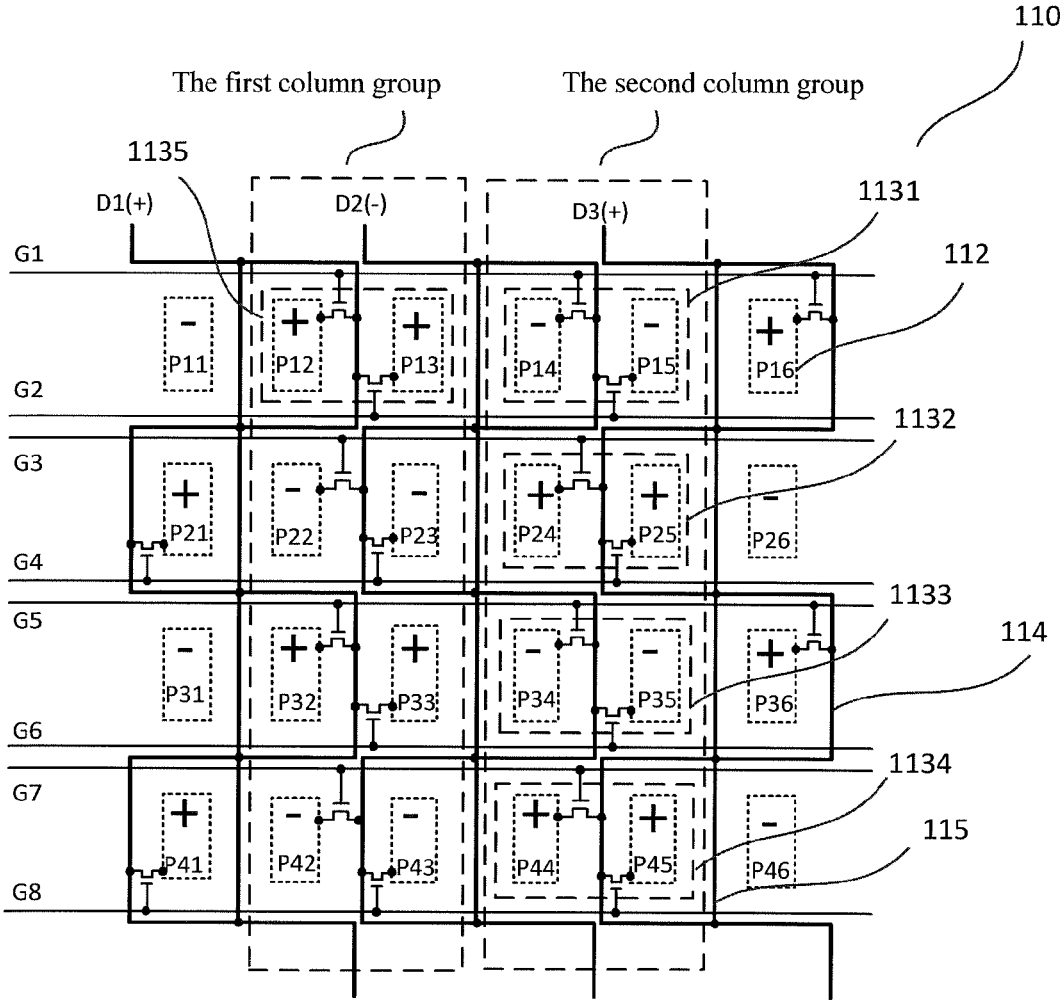
FIG. 2 is a structural schematic diagram of a HSD display panel according to Example 1 of the present disclosure.

FIG. 2 is a structural schematic diagram of a display panel 110 according to the present example. In the present example, the display panel 110 comprises scanning lines G1 to G8 and data lines D1 to D3 that are arranged in a staggered manner, and a plurality of sub pixel units 112 connected to the scanning lines and the data lines.

Specifically, as shown in FIG. 2, each data line comprises a plurality of winding parts 114, and vertical connecting parts 115 connected to the winding parts 114. Sub pixel unit P14 is connected with scanning line G1 and data line D2, and sub pixel unit P15 is connected with scanning line G2 and data line D2. The sub pixel units P14 and P15 form a sub pixel unit group 1131, with the sub pixel units P14 and P15 being arranged on both sides of the data line D2 respectively. Similarly, sub pixel unit P24 is connected with scanning line G3 and data line D3, and sub pixel unit P25 is connected with scanning line G4 and data line D3. The sub pixel units P24 and P25 form a sub pixel unit group 1132, with the sub pixel units P24 and P25 being arranged on both sides of the data line D3 respectively. Likewise, sub pixel unit group 1133 comprises sub pixel units P34 and P35, and sub pixel unit group 1134 comprises sub pixel units P44 and P45, the details of which are no longer repeated here.

In this way, due to the winding parts of data lines D2 and D3, the sub pixel unit groups 1131 and 1133 connected to the data line D2 and the sub pixel unit groups 1132 and 1134 connected to the data line D3 are aligned vertically, thus forming a second column group. Similarly, sub pixel unit groups connected to data lines D1 and D2 are aligned vertically, thus forming a first column group. Therefore, each sub pixel unit group in the present example comprises two sub pixel units aligned side by side, and each column group comprises a plurality of sub pixel unit groups that are aligned vertically and connected to adjacent data lines.

Figure 3:
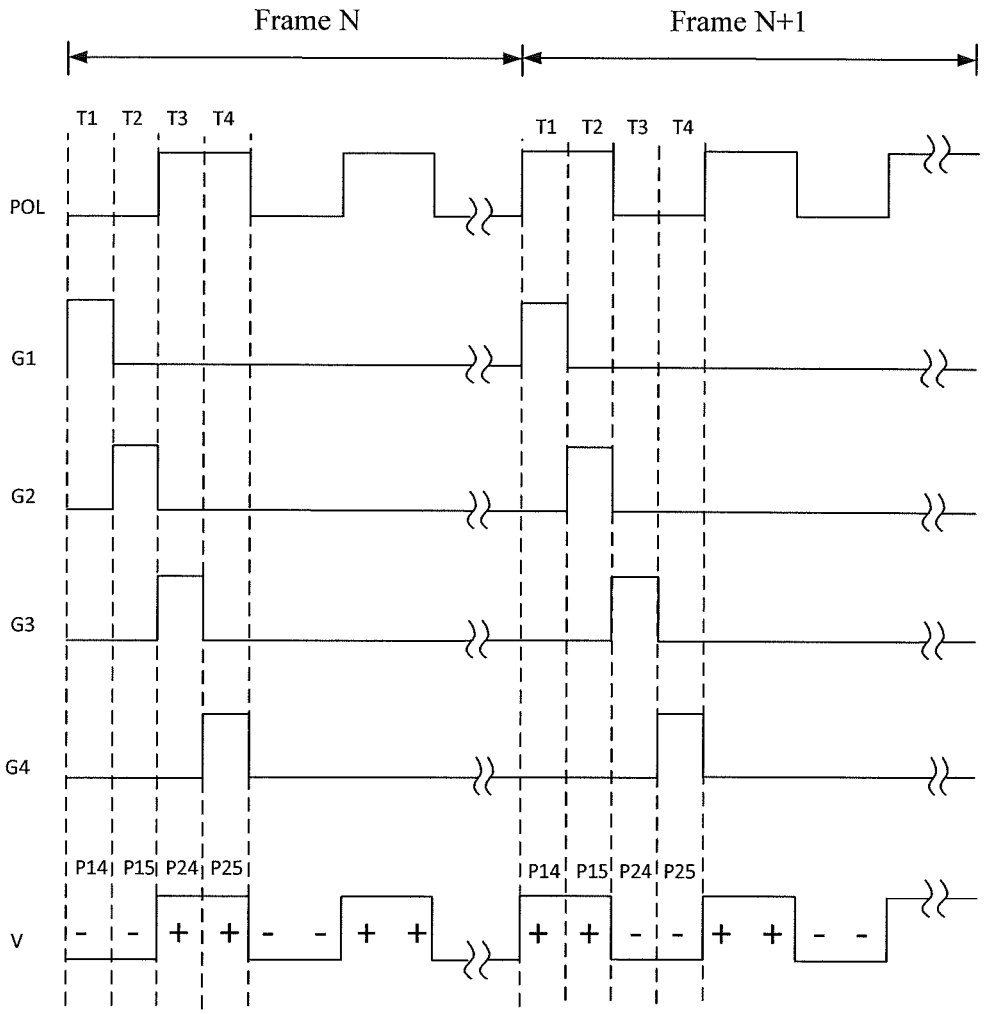
FIG. 3 is a signal timing diagram of the display device according to Example 1 of the present disclosure.

FIG. 3 is a signal timing diagram of the display device 100 according to the present example. The timing control unit 140 can generate a periodic polarity reversing control signal POL, for controlling the polarity of said data signal in a data line is reversed only once in each frame cycle, so that the polarity of data signals in odd-numbered data line a and the polarity of data signals in even-numbered data lines are opposite to each other at the same moment.

The polarity reversing status of sub pixel units will be explained below taking frame N as an example. In row cycle T1, the scanning line G1 turns on the sub pixel unit P14, the polarity reversing signal POL is low-level, and the data line D2 charges the sub pixel unit P14 with a data signal voltage of negative polarity. In row cycle T2, the scanning line G2 turns on the sub pixel unit P15, the polarity reversing signal POL is low-level, and the data line D2 charges the sub pixel unit P15 with a data signal voltage of negative polarity. Then, in row cycle T3, the scanning line G3 turns on the sub pixel unit P24, the polarity reversing signal POL is high-level, and the data line D3 charges the sub pixel unit P24 with a data signal voltage of positive polarity. In row cycle T4, the scanning line G4 turns on the sub pixel unit P25, the polarity reversing signal POL is high-level, and the data line D3 charges the sub pixel unit P25 with a data signal voltage of positive polarity.

Similarly, in frame N, the data line D2 drives the sub pixel units P34 and P35 with a data signal voltage of negative polarity, and the data line D3 drives the sub pixel units P44 and P45 with a data signal voltage of positive polarity. It could be also understood that, the data line D1 drives the sub pixel units P12 and P13 with a data signal voltage of positive polarity.

Therefore, the polarity of sub pixel unit group 1131 is opposite to that of the adjacent pixel unit group 1135 in the first row, and the polarity of sub pixel unit group 1131 is the same as that of sub pixel unit group 1133 which is spaced from sub pixel unit group 1131 by one row in the second column group. The polarity of data signal voltage of each sub pixel in one sub pixel unit group is the same, and sub pixel unit groups with opposite polarities are spaced from each other in vertical direction.

Likewise, the polarity reversing status of each sub pixel unit will be explained taking frame N+1 as an example. The waveform of square wave of the polarity reversing signal POL in frame N+1 is opposite from that in frame N. In row cycle T1, the scanning line G1 turns on the sub pixel unit P14, the polarity reversing signal POL is high-level, and the data line D2 charges the sub pixel unit P14 with a data signal voltage of positive polarity. In row cycle T2, the scanning line G2 turns on the sub pixel unit P15, the polarity reversing signal POL is high-level, and the data line D2 charges the sub pixel unit P15 with a data signal voltage of positive polarity. Then, in row cycle T3, the scanning line G3 turns on the sub pixel unit P24, the polarity reversing signal POL is low-level, and the data line D3 charges the sub pixel unit P24 with a data signal voltage of negative polarity. In row cycle T4, the scanning line G4 turns on the sub pixel unit P25, the polarity reversing signal POL is low-level, and the data line D3 charges the sub pixel unit P25 with a data signal voltage of negative polarity.

Similarly, in frame N+1, the data line D2 drives the sub pixel units P34 and P35 with a data signal voltage of positive polarity, and the data line D3 drives the sub pixel units P44 and P45 with a data signal voltage of negative polarity. It could be also understood that, the data line D1 drives the sub pixel units P12 and P13 with a data signal voltage of negative polarity.

Therefore, the polarity of sub pixel unit group 1131 is opposite to that of the adjacent pixel unit group 1135 in the first row, and the polarity of sub pixel unit group 1131 is the same as that of sub pixel unit group 1133 which is spaced from sub pixel unit group 1131 by one row in the second column group.

Figure 4:
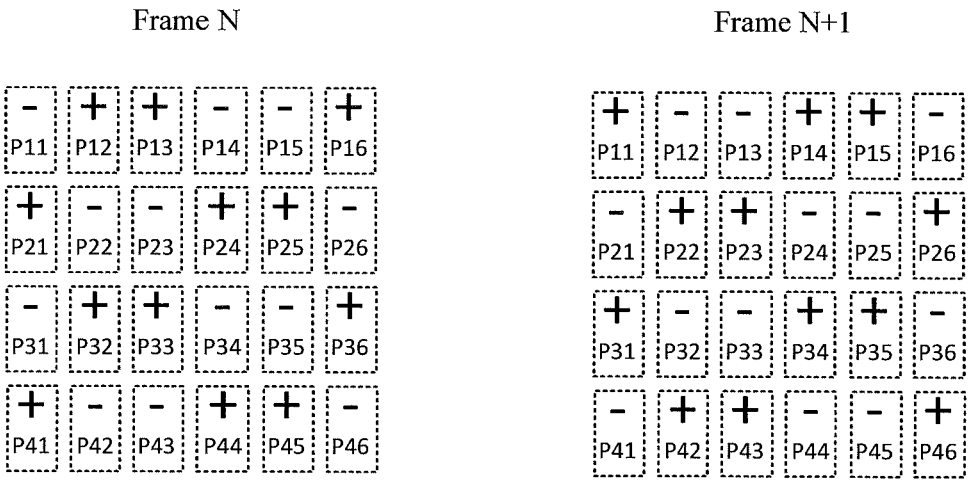
FIG. 4 schematically shows a two-point reversion status of sub pixel units according to Example 1 of the present disclosure.

In the present example, the sub pixel units of the display panel 110 are driven through column reversion, and the polarity of data signal voltage provided by each data line is reversed only once in each frame. Based on the arrangement of sub pixel units, a plurality of winding parts cooperating with the sub pixel units are provided in each data line, so that a two-point reversion display effect as shown in FIG. 4 can be achieved.

The polarity of data driving signal of each sub pixel unit keeps consistent in one frame cycle, which is different from the current HSD two-point reversion driving mode wherein polarity is reversed once in each row cycle. By means of which, the wiring delay effect of data lines can be alleviated, and the phenomenon of dark lines that may occur in current HSD technology can be eliminated.

Figure 5:
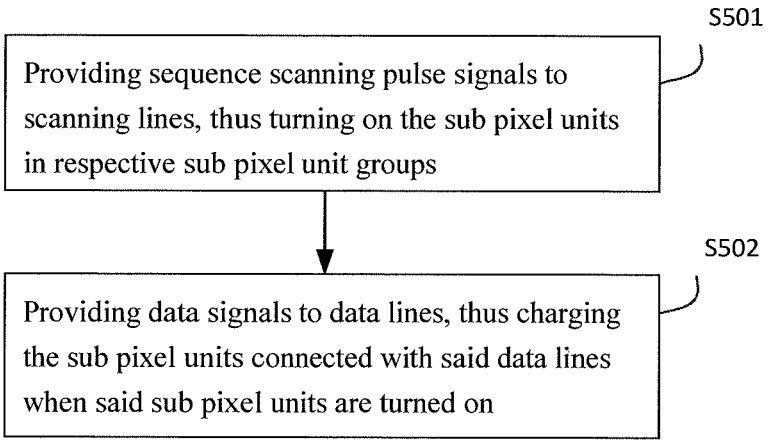
FIG. 5 is a flow chart of a driving method of the display device according to Example 1 of the present disclosure.

The present example also provides a method for driving the liquid crystal display device 100. As shown in FIG. 5, in step S501, sequence scanning pulse signals are provided to scanning lines, thus turning on the sub pixel units in respective sub pixel unit groups. In step S502, data signals are provided to data lines, thus charging the sub pixel units connected with said data lines when said sub pixel units are turned on. The sub pixel units and data lines are arranged as above, the details of which are not repeated here. Reference can be made to FIG. 3 regarding the time-sequence of scanning pulse signals and data signals.

Figure 6:
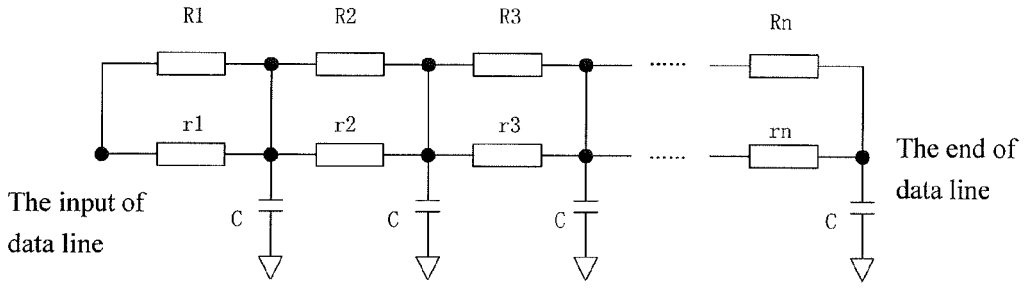
FIG. 6 is a series circuit diagram of RC units of a data line according to Example 1 of the present disclosure.

FIG. 6 is a series circuit diagram of RC units of a data line according to the present Example. In the present example, the vertical connecting parts 115 of the data line are connected with a plurality of winding parts 114. For a plurality of sub pixel units driven by the same data line, the equivalent impedances of the winding parts of the data line are R1, R2, R3 . . . Rn, and the equivalent impedances of the vertical connecting parts are r1, r2, r3 . . . rn. The winding parts and vertical connecting parts are parallel connected, so that the equivalent impedance of the whole data line is reduced and the wiring delay effect is alleviated, thus incorrect charging at the ends of the data line being avoided.

It should be noted that the sub pixel units in the display panel 110 can be combined into vertical strip-like RGB sub pixels, horizontal strip-line RGB sub pixels, or sub pixels with Mosaic or Delta arrangement.

Example 2

Figure 7:
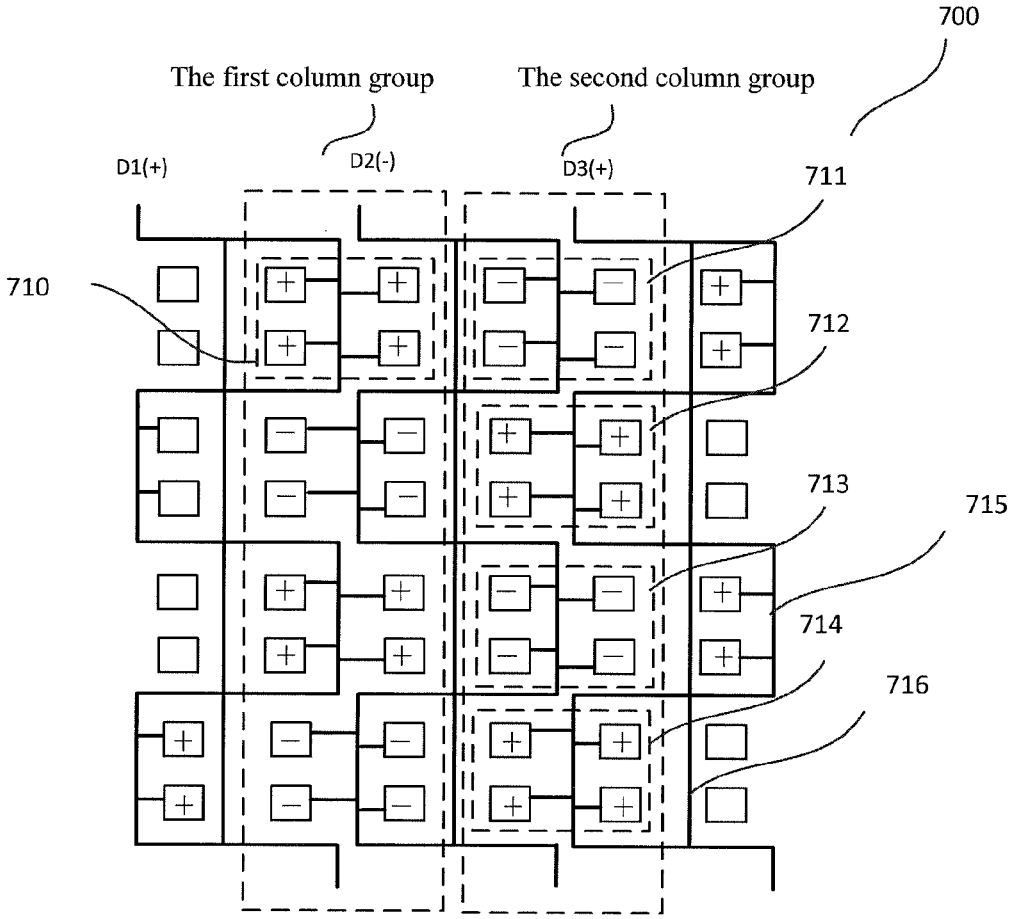
FIG. 7 is a structural schematic diagram of a HSD display panel according to Example 2 of the present disclosure.

The present example provides a HSD display panel and a HSD display device. FIG. 7 is a structural schematic diagram of a HSD display panel according to the present example. The arrangement mode of sub pixel units and the number of winding parts in each data line of the display panel 700 are different from those of Example 1. In FIG. 7, the scanning lines are connected to sub pixel units in the same way as Example 1, and thus the scanning lines are not shown in FIG. 7 for simplicity.

In the present example, each sub pixel unit group comprises four sub pixel units arranged in a matrix form, and each column group comprises a plurality of sub pixel unit groups that are connected to adjacent data lines and arranged vertically. For example, the sub pixel unit group 711 comprises sub pixel units P14, P15, P24, and P25, which are arranged on both sides of the data line D2 respectively. The second column group comprises sub pixel unit groups 711 and 713 connected to the data line D2 and sub pixel unit groups 712 and 714 connected to the data line D3.

Figure 8:
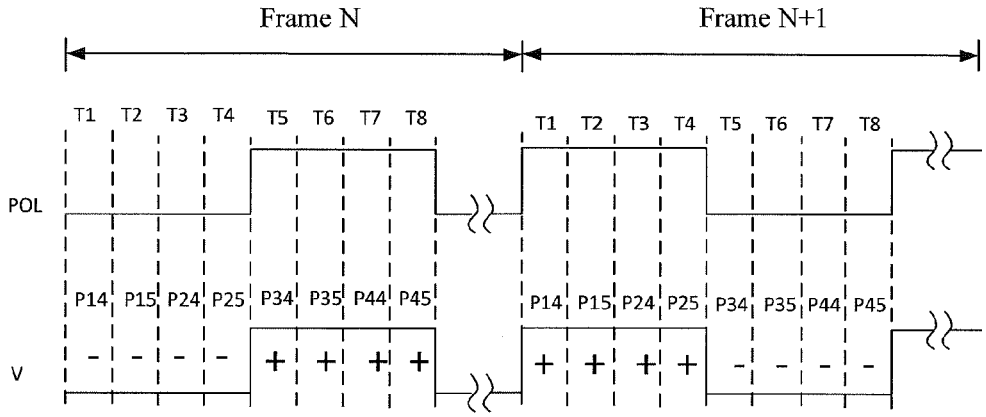
FIG. 8 is a signal timing diagram of a HSD display device according to Example 2 of the present disclosure.

FIG. 8 is a signal timing diagram of the HSD display device according to the present example. As in Example 1, the polarity reversing signal POL is used for reversing the polarity of said data signals only once in each frame, so that the polarity of data signals in odd-numbered data lines and the polarity of data signals in even-numbered data lines are opposite to each other at the same moment.

In frame N, in row cycles T1 to T4, the scanning lines turn on the sub pixel units P14, P15, P24, and P25 in sequence, the polarity reversing signal POL is low-level, and the data line D2 charges the sub pixel units P14, P15, P24, and P25 with a data signal voltage of negative polarity. Then, in row cycles T5 to T8, the scanning lines turn on the sub pixel units P34, P35, P44, and P45 in sequence, the polarity reversing signal POL is high-level, and the data line D3 charges the sub pixel units P34, P35, P44, and P45 with a data signal voltage of positive polarity. It can be also understood that, the data line D1 drives the sub pixel units P12, P13, P22, and P23 with a data signal voltage of positive polarity.

The waveform of square wave of the polarity reversing signal POL in frame N+1 is opposite from that in frame N. In row cycles T1 to T4, the data line D2 charges the sub pixel units P14, P15, P24, and P25 with a data signal voltage of positive polarity. Then, in row cycles T5 to T8, the data line D3 charges the sub pixel units P34, P35, P44, and P45 with a data signal voltage of negative polarity. It can be also understood that, the data line D1 drives the sub pixel units P12, P13, P22, and P23 with a data signal voltage of negative polarity.

Therefore, the polarity of sub pixel unit group 710 is opposite to that of the adjacent pixel unit group 711 in the first and second rows, and the polarity of sub pixel unit group 711 is the same as that of sub pixel unit group 713 which is spaced from sub pixel unit group 711 by two rows in the second column group. The polarity of data signal voltage of each sub pixel in one sub pixel unit group is the same, and sub pixel unit groups with opposite polarities are spaced from each other in vertical direction.

Figure 9:
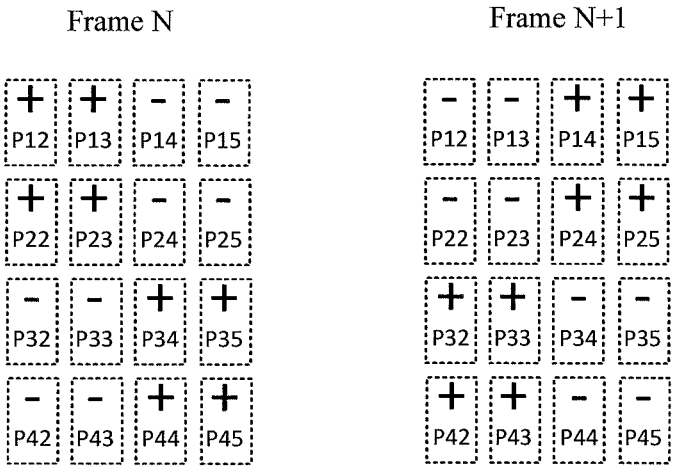
FIG. 9 schematically shows a four-point reversion status of sub pixel units according to Example 2 of the present disclosure.

In the present example, the sub pixel units of the display panel 700 are driven through column reversion, and the polarity of data signal voltage provided by each data line is reversed only once in each frame. Based on the arrangement of sub pixel units and the plurality of winding parts provided in each data line and cooperating with the sub pixel units, a four-point reversion display effect as shown in FIG. 9 can be achieved. The polarity of data driving signal of each sub pixel unit keeps consistent in one frame cycle, which is different from the current HSD two-point reversion driving mode wherein polarity is reversed once in each row cycle. By means of which, the wiring delay effect of data lines can be alleviated, and the phenomenon of dark lines that may occur in current HSD technology can be eliminated.

Likewise, the vertical connecting parts 716 of data line are arrange between sub pixel unit groups and connected with a plurality of winding parts 715. In this manner, the equivalent impedance of the whole data line is reduced, and the wiring delay effect is alleviated, thus incorrect charging at the ends of data line being avoided.

It can be understood by a person skilled in the art that, through reasonably selecting the arrangement of sub pixel units and the number of winding parts in a data line of a display panel, the sub pixel unit groups that are spaced from each other by k rows and connected to data line i and the sub pixel unit groups that are spaced from each other by k rows and connected to data line i+m can be located in the same column group. In addition, the sub pixel unit groups connected to the same date line in the same column group are spaced from each other by k rows, and the sub pixel unit groups connected to the same date line in different column groups are spaced from each other by 2n column groups. In the context, i and k are positive integers, n is integer, and m is odd number.

During display driving, the polarity of a sub pixel unit group is opposite to that of its adjacent pixel unit group in the same row, and the polarity of a sub pixel unit group is the same as that of the sub pixel unit group which is spaced from said sub pixel unit group by k rows in the second column group. Since the polarity of data signal voltage of each sub pixel in the same sub pixel unit group is the same, and sub pixel unit groups with opposite polarities are spaced from each other in the vertical direction, two-point reversion, four-point reversion or other similar display effects can be achieved through the data driving method of column reversion.

Specifically, Example 1 equals to the case of k=1, m=1, and n=0, and Example 2 equals to the case of k=2, m=1, and n=0. As k increases, the number of sub pixel units wound by the winding parts in each column increases accordingly. As n increases, the number of sub pixel units wound by the winding parts in each row increases accordingly.

While the present disclosure discloses the embodiments as mentioned above, the embodiments are adopted to facilitate the understanding of the present disclosure, rather than to limit it. One skilled in the art may make any modifications and changes to the forms and details of the embodiments without departing from the spirit and scope of the present disclosure. The extent of protection of the present disclosure shall be determined by the scope as defined in the claims.

The invention claimed is:

1. A HSD liquid crystal display panel, comprising a plurality of sub pixel unit groups connected with data lines and scanning lines, wherein each data line comprises a plurality of winding parts; and wherein the sub pixel unit groups that are spaced from each other by k rows and connected to data line i and the sub pixel unit groups that are spaced from each other by k rows and connected to data line i+m are located in the same column group, so that during display driving the polarity of a sub pixel unit group is opposite to that of its adjacent sub pixel unit group in the same row, and the polarity of a sub pixel unit group is the same as that of the sub pixel unit group which is spaced from said sub pixel unit group by k rows in the same column group, i and k being positive integers and m being an odd number;

wherein each data line further comprises vertical connecting parts connected with said winding parts and located between adjacent sub pixel unit groups.

2. The liquid crystal display panel of claim 1, wherein the sub pixel unit groups connected to the same date line in the same column group are spaced from each other by k rows, and the sub pixel unit groups connected to the same date line in different column groups are spaced from each other by 2n column groups, k being positive integer and n being integer.

3. The liquid crystal display panel of claim 2, wherein each sub pixel unit group comprises a first sub pixel unit and a second sub pixel unit arranged side by side and located at both sides of the data line respectively.

4. The liquid crystal display panel of claim 1, wherein each sub pixel unit group comprises a first sub pixel unit and a second sub pixel unit arranged side by side and located at both sides of the data line respectively.

5. The liquid crystal display panel of claim 3, wherein said first sub pixel unit is connected with odd-numbered scanning line and said second sub pixel unit is connected with even-numbered scanning line.

6. The liquid crystal display panel of claim 4, wherein said first sub pixel unit is connected with odd-numbered scanning line and said second sub pixel unit is connected with even-numbered scanning line.

7. A HSD liquid crystal display device, comprising:

a liquid crystal displaying panel, comprising a plurality of sub pixel unit groups connected with data lines and scanning lines, wherein each data line comprises a plurality of winding parts; and wherein the sub pixel unit groups that are spaced from each other by k rows and connected to data line i and the sub pixel unit groups that are spaced from each other by k rows and connected to data line i+m are located in the same column group, so that during display driving the polarity of a sub pixel unit group is opposite to that of its adjacent sub pixel unit group in the same row, and the polarity of a sub pixel unit group is the same as that of the sub pixel unit group which is spaced from said sub pixel unit group by k rows in the same column group, i and k being positive integers and m being an odd number;

a scanning signal driving unit for providing sequence scanning pulse signals to said scanning lines, thus turning on the sub pixel units in respective rows; and a data signal driving unit for providing data signals to said data lines, thus charging the sub pixel units connected with said data lines when said sub pixel units are turned on, wherein the polarity of said data signal is reversed once through each frame cycle;

wherein each data line further comprises vertical connecting parts connected with said winding parts, which are located between adjacent sub pixel unit groups.

8. The liquid crystal display device of claim 7, wherein the sub pixel unit groups connected to the same date line in the same column group are spaced from each other by k rows, and the sub pixel unit groups connected to the same date line in different column groups are spaced from each other by 2n column groups, k being positive integer and n being integer.

9. The liquid crystal display device of claim 8, wherein each sub pixel unit group comprises a first sub pixel unit and a second sub pixel unit arranged side by side and located in both sides of the data line respectively.

10. The liquid crystal display device of claim 7, wherein each sub pixel unit group comprises a first sub pixel unit and a second sub pixel unit arranged side by side and located in both sides of the data line respectively.

11. The liquid crystal display device of claim 9, wherein said first sub pixel unit is connected with odd-numbered scanning line and said second sub pixel unit is connected with even-numbered scanning line.

12. The liquid crystal display device of claim 10, wherein said first sub pixel unit is connected with odd-numbered scanning line and said second sub pixel unit is connected with even-numbered scanning line.

13. The liquid crystal display device of claim 7, wherein the polarity of data signals in odd-numbered data lines and the polarity of data signals in even-numbered data lines are opposite at the same moment.

14. The liquid crystal display device of claim 8, wherein the polarity of data signals in odd-numbered data lines and the polarity of data signals in even-numbered data lines are opposite at the same moment.

15. The liquid crystal display device of claim 7, further comprising:

a timing control unit for providing polarity reversing signals and to reverse the polarity of said data signals once through each frame cycle, and to enable the polarity of data signals in odd-numbered data lines and the polarity of data signals in even-numbered data lines are opposite at the same moment.

16. The liquid crystal display device of claim 8, further comprising:

a timing control unit for providing polarity reversing signals and to reverse the polarity of said data signals once through each frame cycle, and to enable the polarity of data signals in odd-numbered data lines and the polarity of data signals in even-numbered data lines are opposite at the same moment.

17. A method of driving a HSD liquid crystal display device, comprising:

providing sequence scanning pulse signals to scanning lines to turn on sub pixel units in respective sub pixel unit groups; and providing data signals to data lines, thus charging the sub pixel units connected with a data line when a corresponding sub pixel unit is turned on, wherein the sub pixel unit groups spaced from each other by k rows connected to data line i and the sub pixel unit groups spaced from each other by k rows connected to data line i+m are located in the same column group, and the sub pixel unit groups connected to the same date line in the same column group are spaced from each other by k rows, and the sub pixel unit groups connected to the same date line in different column groups are spaced from each other by 2n column groups, i and k being positive integers, n being an integer, and m being an odd number;

wherein each data line further comprises vertical connecting parts connected with said winding parts, which are located between adjacent sub pixel unit groups; and wherein the polarity of said data signal is reversed once through each frame cycle, so that during display driving the polarity of a sub pixel unit group is opposite to that of its adjacent sub pixel unit group in the same row, and the polarity of a sub pixel unit group is the same as that of the sub pixel unit group which is spaced from said sub pixel unit group by k rows in the same column group.

18. The driving method of claim 17, wherein the polarity of data signals in odd-numbered data lines and the polarity of data signals in even-numbered data lines are opposite at the same moment.

* * * * *